US005454368A

United States Patent [19]

Tarulli

[11] Patent Number: 5,454,368

[45] Date of Patent: Oct. 3, 1995

[54] CRITICAL CARE COMPLEX

[76] Inventor: Joseph R. Tarulli, 6325 Eaton St., Hollywood, Fla. 33024

[21] Appl. No.: 267,821

[22] Filed: Jun. 28, 1994

[51] Int. Cl.[6] ..... A61G 11/00

[52] U.S. Cl. ..... 128/205.26; 128/202.12

[58] Field of Search ..... 128/205.26, 200.14, 128/202.12, 202.16; 600/21, 22

[56] References Cited

U.S. PATENT DOCUMENTS

| | | | |
|---|---|---|---|
| 2,706,473 | 4/1955 | Armstrong et al. | 600/22 |
| 3,187,744 | 6/1965 | Dorsak et al. | 600/22 |
| 3,610,716 | 10/1971 | Weinberg | 600/22 |
| 3,818,896 | 6/1974 | Deaton | 600/22 |
| 4,034,740 | 7/1977 | Atherton et al. | 600/22 |
| 4,129,123 | 12/1978 | Smidak | 600/21 |
| 4,161,172 | 7/1979 | Pickering | 600/22 |
| 4,356,967 | 11/1982 | Lunick | 600/22 |
| 5,330,415 | 7/1994 | Storti et al. | 128/205.26 |

*Primary Examiner*—Edgar S. Burr
*Assistant Examiner*—Aaron J. Lewis
*Attorney, Agent, or Firm*—Herbert L. Lerner; Laurence A. Greenberg

[57] ABSTRACT

A critical care complex includes a housing and modular electronic units. The housing has at least two chambers formed therein which are separately and independently operated. Each of the chambers has a removable front wall in the form of a see-through window. The chambers are provided with air inlet openings in which the environment control air enters the respective chamber. An electronic module is removably attached to the housing such that its air opening communicates with the air inlet into the chamber. The electronic module controls the temperature and the humidity in the chambers by feeding the control air through the air outlet and inlet openings.

6 Claims, 2 Drawing Sheets

CRITICAL CARE COMPLEX

BACKGROUND OF THE INVENTION

1. Field of the Invention

The invention relates to a critical care unit for both human and veterinary use, for patients in critical condition, in need of life saving or supporting heat, humidity, oxygen ($O_2$), nebulization, to sustain or improve upon vital life functions. More particularly, the invention pertains to an incubator providing heat, humidity, oxygen and nebulization capability, and to an anesthetic induction chamber with anesthetic induction capability.

The modular critical care unit is a device which is used for the health care of both human infants and animal patients. It has the capability to provide heat, humidity, $O_2$, nebulization, and anesthetics, for the patient within the chamber.

SUMMARY OF THE INVENTION

It is accordingly an object of the invention to provide a critical care complex, which overcomes the hereinaforementioned disadvantages of the heretofore-known devices of this general type and which provides a compact, modular combination incubator and anesthetic induction chamber providing heat, humidity, oxygen and nebulization capability, along with anesthetic induction capability.

While other devices of this type exist, it is the intention of the inventor to provide a double unit or device, both housed within the;same housing or framework, one above the other, in order to be space saving and cost effective.

With the foregoing and other objects in view there is provided, in accordance with the invention, a critical care complex, comprising:

a housing having at least two chambers formed therein; each of the chambers being defined by a backwall, a floor, a ceiling, two side walls and a removable front wall;

each of the chambers having an air inlet opening formed therein for admitting control air into the chamber;

an electronic module removably attached to the housing and having an air outlet opening formed therein aligned with the air inlet opening formed in one of the chambers, the electronic module having means for controlling a temperature and a humidity in a respective one of the chambers by feeding the control air through the air outlet opening, to the air inlet opening and into the respective one of the chambers.

In accordance with an added feature of the invention, the removable front wall is formed of plexiglass and the plexiglass wall has an air duct formed thereon defining the air inlet opening aligned with the air outlet opening.

In accordance with another feature of the invention, the electronic module has an air duct formed therein communicating with the air outlet opening, and a fan and an air heater disposed in the air duct.

In accordance with a further feature of the invention, the critical care complex includes a humidifier system disposed in the air duct.

In accordance with again another feature of the invention, each of the chambers is provided with an oxygen inlet port, with an anesthetic inlet port and a nebulization port.

In accordance with a concomitant feature of the invention, the removable front wall has adjustable air vents formed therein for effecting a gas exchange with an outside of the chamber.

In summarizing the invention, a double unit is provided with both units or chambers formed in the same housing, but each independently operated. Each chamber has its own module to provide independent it heat, humidity, $O_2$, nebulization, or anesthetics. The individual chambers may therefore simultaneously have different interior climates for individual needs.

A compact, space having device is provided, with an upper and lower chamber and module.

As mentioned, the two or more chambers are operated separately and in dependently of each other, within the same housing or framework, thereby providing a cost effective apparatus and method of providing two incubators at a cost less than two separate incubators would be. This would make it possible for hospitals or clinics to afford this vital life saving equipment, which would otherwise not be available to the due to cost.

An important feature of the invention is the provision of an independent heating and humidity module or device, as a separate module, which will instantly clip on or off the chamber, thereby making replacement or service to the module easy and less the consuming.

By providing two separate, independently operated chambers and modules it is possible to provide tailored environments simultaneously with independently operated modules or climate control units.

In other words, the chambers do not share anything in common except the cabinet housing.

A primary object of the invention is to provide two separate chambers functioning independently of each other, within the same housing or framework, thereby being space saving and cost effective.

Another object of the invention is to provide a device which contains a separate heating and humidity module, which clips on and off each Chamber easily and quickly. If the device was to malfunction, such a module could be replaced easily, thereby restoring fast efficient operation again, while the malfunctioning component is being serviced. Any lay person would be able to connect and disconnect the module to the chamber instantly and quickly. In effect, a loaner component or module could assure that the down time on a malfunctioning unit would be very brief in comparison to existing devices which must be serviced by a repairman, or sent back for repair, in which case the device would be unavailable for use.

An additional object is to provide heat and humidity into the chambers, and the appropriate ports provided for the entry of oxygen and nebulization into the chambers, to maintain or improve life functions, or to provide a controlled environment of the same.

A still further object of the invention is to provide the ability to provide anesthetic gases and oxygen into the chamber in order to accomplish the anesthetic induction of the patient, in effect, an anesthetic induction chamber.

Other features which are considered as characteristic for the invention are set forth in the appended claims.

Although the invention is illustrated and described herein as embodied in a critical car complex, it is nevertheless not intended to be limited to the details shown, since various modifications and structural changes may be made therein without separting from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
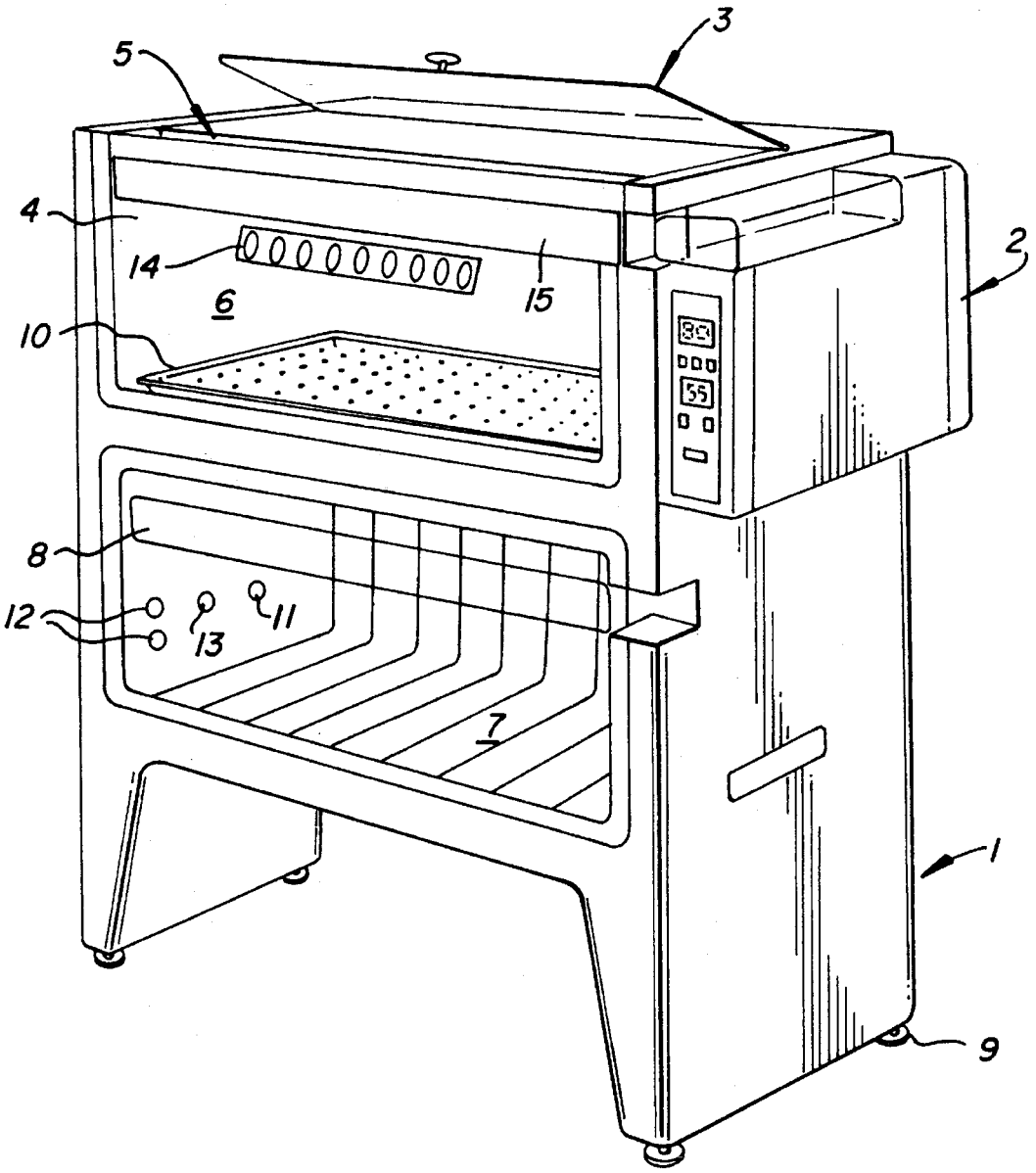
FIG. 1 is a front to perspective view of a two-chamber modular device with one electronic control module attached.

Referring now to the figures of the drawing in detail and first, particularly, to FIG. 1 thereof, there is seen a critical care complex which is formed of a housing 1, also referred to as a basic frame 1, housing at least two independently operated chambers 6 and 7. The chambers 6 and 7 are disposed one above the other. Each of the chambers 6 and 7 is provided with mechanical attachment means for attaching electronic control modules 2. The electronic control modules—also referred to as heating/humidity modules—clip onto the basic frame and they provide heat and humidity to the interior of respective ones of the chambers 6 and 7.

The upper chamber 6 is provided with an incubator door 3, which is equipped with a latch and a handle.

The fronts of the chambers are provided with a viewing window 4 or front glass 4 each, for example formed of a full surface plexiglass side. The front glass 4 includes an air duct 15 along/its interior. The air duct 15 guides an air stream of a desired temperature and humidity from the electronic unit 2 to the chamber interior. The front glass 4 also is provided with adjustable air vents 14, which allow for the exchange of gases between the chamber interior and the exterior. The air vents 14 may be manually actuated or they may be connected to the electronic module 2 for automatic operation. It is well within the skill of the engineer to provide a spindle drive or similar structure for remotely actuating the air vents 14.

A support bar 5 provides a support for the incubator door 3 and its provides a seal between the door 3 and the front glass 4.

The two chambers 6 and 7 may be equal or different in size. While the top chamber 6 may be opened from the top (door 3), the bottom chamber 7 may be opened from the front. As defined, each of the chambers has a backwall, a floor, a ceiling, and two side walls which are each integral with the basic frame 1. The upper chamber 6 may be provided with the removable lid 3.

The bottom chamber 7 is provided with grooves in the housing for a bottom window 8, for instance a plexiglass insert. The plexiglass insert is provided with mating members, which fit into the various grooves. The bottom chamber (which may be subdivided into several chambers) may thus be provided as an anesthetic induction chamber of any required size.

The lower chambers front door 8 is further provided with a latch, air ducts and vents. The housing frame is provided with adjustable support feet 9, possibly in the form of casters.

Each of the chambers 6 and 7 is provided with an interior chamber tray 10, for instance a glass tray, for easy and quick cleanup of fluids or waste.

The chamber 7 is further provided with a number of inlet ports, for instance an oxygen inlet port 11, two anesthetic inlet ports 12, and a nebulization port 13.

Figure 2:
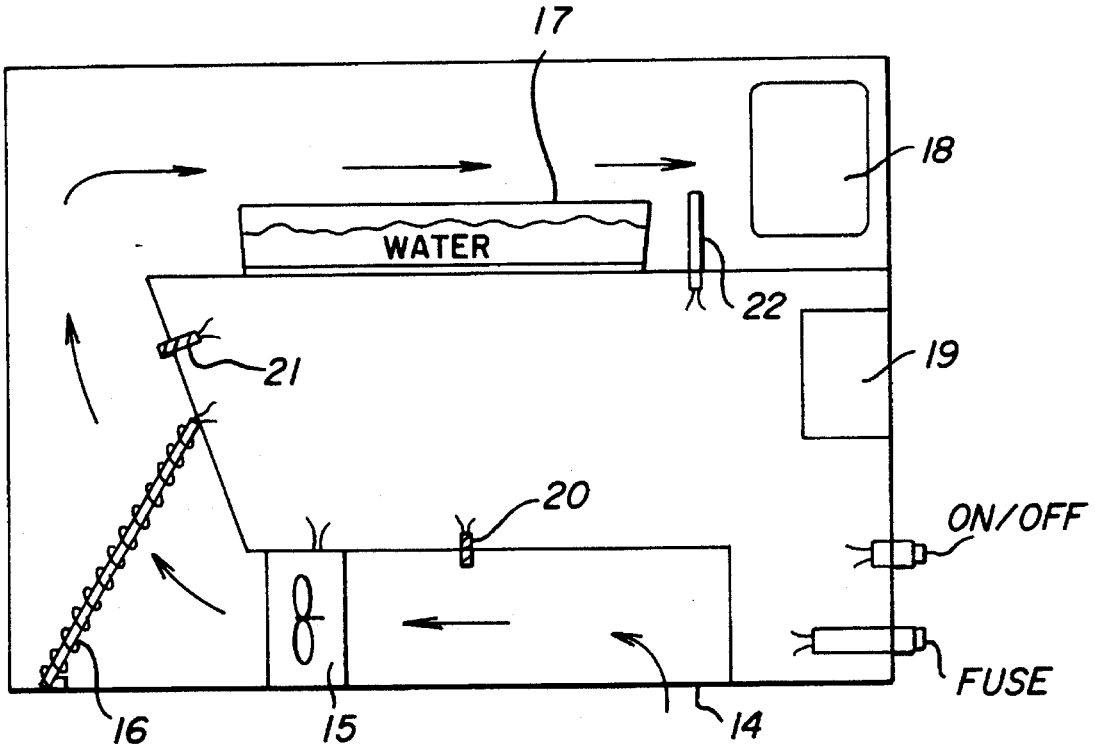
FIG. 2 is diagrammatic, elevational X-ray view through a heating module according to the invention.
Figure 3:
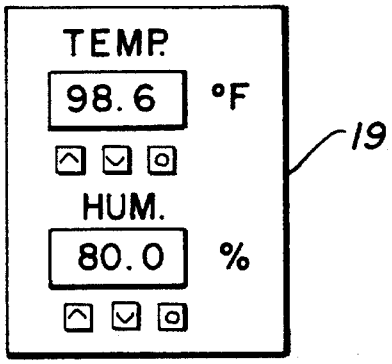
FIG. 3 is a front -elevational view of an electronic control unit.

Referring now to FIG. 2, air is aspirated into an air duct in the electronic module 2 at a filter grid 14. An inline fan 15 provides the necessary suction. The air then passes by a heater 16, for instance a resistance wire grid. After the heated air flow passes by a water tray 17, it exits the electronic module 2 at an exit port 18, which is aligned with the air duct 15 in the front window 4. Various sensors may be provided within the module 2. There are shown a temperature sensor 20 for the incoming air, a temperature sensor 21 for the heated air downstream of the heater grid 16 and a humidity sensor 22. Each of the sensors is electrically connected to an electronic control 19.

The electronic control 19, which is disposed in a sub-housing in the module 2, controls the temperature and the humidity of a single chamber by means of feeding control air into the chamber. Various controls are provided on the electronic control, and it includes a temperature display and a humidity display.

It should be understood that the rudimentary humidifier system as shown With the water pan 17 is but exemplary of the invention. Any type of humidifier may be incorporated in the module 2, the engineering decision to be left to the person of skill in the art.

I claim:

1. A critical care complex, comprising:

a housing having at least two chambers formed therein; each of said chambers being defined by a backwall, a floor, a ceiling, two side walls and a removable front wall;

each of said chambers having an air inlet opening formed therein for admitting control air into said chamber;

means for supplying each of said chambers independently of one another with a defined flow of control air, said supply means including an electronic module removably attached to said housing and having an air outlet opening formed therein aligned with said air inlet opening formed in one of said chambers, said electronic module having means for controlling a temperature and a humidity in a respective one of said chambers by feeding the control air through said air outlet opening, to said air inlet opening and into the respective one of said chambers; and means for selectively dividing at least one of said chambers into a plurality of chambers for varying a size of said at least one chamber.

2. The critical care complex according to claim 1, wherein said removable front wall is formed of plexiglass and said plexiglass wall has an air duct formed thereon defining said air inlet opening aligned with said air outlet opening.

3. The critical care complex according to claim 1, wherein said electronic module has an air duct formed therein communicating with said air outlet opening, and a fan and an air heater disposed in said air duct.

4. The critical care complex according to claim 3, including a humidifier system disposed in said air duct.

5. The critical care complex according to claim 1, wherein each of said chambers is provided with an oxygen inlet port, with an anesthetic inlet port and a nebulization port.

6. The critical care complex according to claim 1, wherein said removable front wall has adjustable air vents formed therein for effecting a gas exchange with an outside of said chamber.

* * * * *